US006193591B1

(12) United States Patent
Stahl et al.

(10) Patent No.: US 6,193,591 B1
(45) Date of Patent: Feb. 27, 2001

(54) LOADING SYSTEM AND COLLECT ASSEMBLY FOR GRINDING A WORKPIECE

(75) Inventors: Joseph John Stahl, Webster; Stephen Joseph Rookey, West Henrietta; David Arden Sutton, Canandaigua, all of NY (US)

(73) Assignee: Ten Cate Enbi International bv (NL)

( * ) Notice: Subject to any disclaimer, the term of this patent is extended or adjusted under 35 U.S.C. 154(b) by 0 days.

(21) Appl. No.: 09/449,372

(22) Filed: Nov. 24, 1999

(51) Int. Cl.[7] ..... B24B 5/00

(52) U.S. Cl. ..... 451/243; 451/114; 451/177; 451/209; 451/229; 451/253; 279/4.08; 279/51

(58) Field of Search ..... 279/4.08, 51; 451/114, 451/177, 209, 229, 253

(56) References Cited

U.S. PATENT DOCUMENTS

| | | | | |
|---|---|---|---|---|
| 5,312,212 | * | 5/1994 | Naumec | 409/138 |
| 5,375,458 | * | 12/1994 | Oliver et al. | 73/49.8 |
| 5,806,859 | * | 9/1998 | Saccomanno, III | 279/143 |
| 5,947,485 | * | 9/1999 | Nguyen | 279/46.2 |

* cited by examiner

*Primary Examiner*—David A. Scherbel
*Assistant Examiner*—Shantese McDonald

(74) *Attorney, Agent, or Firm*—Woodard, Emhardt, Naughton, Moriarty & McNett

(57) ABSTRACT

An assembly for holding a cylindrical workpiece for grinding, including a support frame having at least one support arm extending to initially hold the workpiece and operable to disengage from the workpiece during grinding, a tailstock slidably mounted on the support frame and operable to engage the proximal end of the workpiece, and a collet assembly mounted on the support frame and configured to receive and engage the distal end of the workpiece. The collet assembly includes a housing having an open proximal end, an open distal end, and an internal channel with an inner diameter. The internal channel extends along the length of the housing from the open proximal end to the open distal end and is adapted to slidingly receive a spindle. The spindle has a proximal end portion and a distal end portion. The proximal end portion includes a holding portion and the distal end extends from the distal end of the housing and is engagable with a drive mechanism. The collet is slidably disposed within the proximal end portion of the housing. The distal end of the collet is attached to the holding portion of the spindle. The collet is resiliently biased so that the collet opens when advanced in the proximal direction, and so that the proximal portion of the housing urges the collet to close when the collet is retracted in the distal direction. The assembly further includes means engagable with the spindle for selectively advancing the spindle within the housing to advance the collet. A spring is disposed between the housing and the spindle and biased to resiliently urge said spindle in the distal direction.

20 Claims, 7 Drawing Sheets

LOADING SYSTEM AND COLLECT ASSEMBLY FOR GRINDING A WORKPIECE

FIELD OF THE INVENTION

This invention relates generally to grinding machines and more particularly to a system and collet assembly for loading, holding, turning and ejecting a workpiece.

BACKGROUND OF THE INVENTION

In grinding cylindrical workpieces, such as rollers, it is desirable to make consistent end products from the rough workpieces as efficiently as possible. Aside from the actual grinding time, improvements are needed to minimize the time necessary to load, clasp, rotate, move and eject the workpieces. Although in some cases the process has been automated, it is still desirable to improve machining efficiency and cycle time. One area in which time and efficiency are lost is in engaging and disengaging the workpiece by the grinding machine. In particular, many grinding machines use a collet or cylindrical, slotted clamp to engage one end of the workpiece, whereafter the collet is rotated to rotate the workpiece. Engineering difficulties have been encountered in configuring the collet to engage the workpiece quickly, allowing the collet to rotate, and disengaging the collet from the workpiece.

One response to this challenge has been to mount an outwardly biased collet within a cylindrical sleeve which is clamped in place, such as described in U.S. Pat. Nos. 5,443,411 and 5,556,326, both to Rouyer et al. and incorporated herein in their entirety. The collet is both rotated and extended to allow it to expand and then retracted with a rotation and translation motion to close and lock it relative to the sleeve. Specifically, the collet receives the end of the workpiece when the collet is in the extended open position. The collet is then turned and retracted into clamped sleeve, closing the collet untiocollet firmly clasps the workpiece and abuts the sleeve. The clamp on the sleeve is then released and the sleeve and collet are jointly rotated to turn the workpiece for grinding. After grinding, the sleeve is again clamped and the collet turned and extended to release the workpiece. This approach requires an excessive number of working parts and steps, and adds complexity, wear and tear, and processing time to the system.

Consequently, there is a need for an improved method of loading, clamping, and releasing a workpiece for grinding. The present invention addresses these needs.

SUMMARY OF THE INVENTION

The present invention relates to an assembly for holding a cylindrical workpiece for grinding. Normally the workpiece has a proximal end and a distal end. The assembly is based on a support frame having at least one support arm extending to initially hold the workpiece and operable to disengage from the workpiece during grinding. A tailstock is slidably mounted on the support frame and operable to engage the proximal end of the workpiece.

In one preferred embodiment, a collet assembly is mounted on the support frame and configured to receive and engage the distal end of the workpiece. The collet assembly includes a housing having an open proximal end, an open distal end, and an internal channel. The internal channel extends the length of the housing from the open proximal end to the open distal end. A spindle is slidably disposed within the internal channel of the housing. The spindle has a proximal end portion and a distal end portion wherein the proximal end portion includes a holding portion and wherein the distal end extends from the distal end of the housing and is engagable with a drive mechanism.

A collet is slidably disposed within the proximal end portion of the housing, wherein the collet has a proximal end adjacent the proximal end portion of the housing. The distal end of the collet is engaged by the holding portion of the spindle. The collet is resiliently biased so that the collet opens when advanced in the proximal direction, and so that the proximal portion of the housing urges the collet to close when the collet is retracted in the distal direction.

The assembly includes means engagable with the spindle for selectively advancing the spindle within the housing to advance the collet. A spring is disposed between the housing and the spindle and biased to resiliently urge said spindle in the distal direction.

It is one object of the invention to provide an improved collet assembly and system for loading, clamping, rotate and ejecting a workpiece.

Further objects, features and advantages of the present invention shall become apparent from the detailed drawings and descriptions provided herein.

DESCRIPTION OF PREFERRED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

The present invention provides an improved loading system and collet assembly for grinding a workpiece. One example of such a workpiece is a paper handling roller with a metal bar core having a rubber sheath formed around it, wherein the rubber sheath needs to be sized. In operation, once a workpiece is loaded onto the support arms, the tailstock engages one end of the workpiece, pushing the opposing end into the collet assembly. The collet then clamps an end of the workpiece and is rotated. The workpiece is then translated into position for grinding and is ground until a desired workpiece diameter is achieved. The workpiece translation is then reversed and the workpiece is ejected from the system. The present invention provides reduced complexity and improved speed in processing each workpiece.

Figure 1:
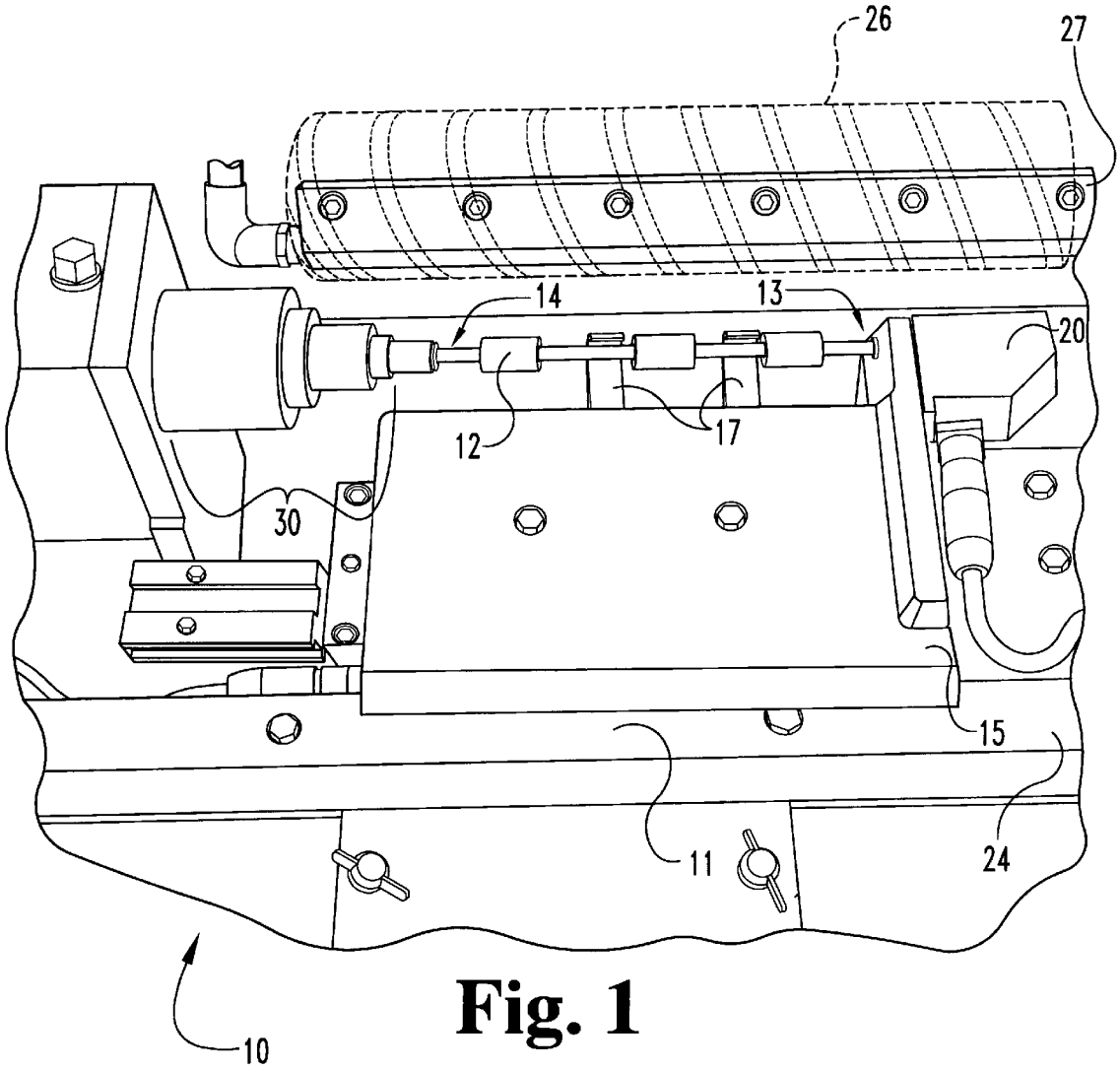
FIG. 1 is a perspective view of a system according to one embodiment of the present invention.

FIG. 1 illustrates a perspective view of one embodiment of a loading system 10. Loading system 10 is mounted on frame 11. A workpiece 12 having a proximal end 13 and a distal end 14 is loaded onto support arm(s) 17. Preferably, there are at least two support arms 17 operationally coupled to cover 15 such that the support arms may be positioned to accept workpieces 12 of varying lengths. Support arms 17 may be hooked, notched, or otherwise adapted to receive and hold a workpiece 12. In alternate embodiments, support arms 17 can be placed at various support positions on workpiece 12.

Once workpiece 12 loaded in place, tailstock 20 advances the line with workpiece 12 until tailstock 20 engages proximal end 13 of workpiece 12. Tailstock 20 then advances workpiece 12 until distal end 14 enters collet assembly 30. Once workpiece 12 is in place, collet assembly 30 is activated to clamp distal end 14 and support arms 17 are withdrawn. Portions of collet assembly 30 are then rotated, imparting a rotation to workpiece 12. Loading system 10 then laterally advances toward grinder 26 and rotating workpiece 12 is presented to grinder 26. Grinder 26 is preferably a grinding wheel or drum, and is more preferably covered by a protective canopy 27, which is automatically raised as workpiece 12 is moved to engage grinder 26. Grinder 26 rotates in a direction opposite the rotation of workpiece 12, thus grinding workpiece 12 until the desired diameter is reached. A biasing center support (not shown) may optionally be used to bias the center of the workpiece 12 to prevent bowing. Loading system 10 then translates laterally in a reverse direction to withdraw workpiece 12 from grinder 26, and collet assembly 30 unclamps and ejects workpiece 12. Preferably, these operations are directed by an electronic controller (not shown), but may be directed mechanically or manually as desired.

FIGS. 2–9 illustrate collet assembly 30 and various component parts. Collet assembly 30 is shown in detail in FIG. 2. Collet assembly 30 includes generally cylindrically shaped housing 31 (shown in detail in FIGS. 3, 6A, and 6B) with internal channel 32 defining an inter channel diameter. Housing 31 has a housing proximal end 33 oriented generally toward the expected workpiece and an opposite housing distal end 34. Spindle 40 (illustrated in detail in FIGS. 3, 5A, and 5B) is slidably disposed within internal channel 32 of housing 31. Spindle 40 has spindle proximal end 47, which ends in holding portion 38, oriented toward housing proximal end 33. Spindle distal end 48 extends beyond housing 31 and is adapted to be engaged by a rotation drive (not shown). Collet 44 is mounted in internal channel 32 adjacent housing proximal end 33. Collet 44 includes collet distal end 46 attached to holding portion 38 of spindle 40. Ring 35 encircles a distal portion 43 of spindle 40 outside and adjacent to housing 31 and is disposed between housing 31 and a washer 36 held on spindle 40 by nut 37.

Outside of housing 31 is a reciprocating member, such as ring 55, which is connected through housing 31 to spindle 40 by pin 58. Ring 55, spindle 40 and housing 31 have overlappingly aligned retaining pin holes for pin 58. Displacement member 52 is adjacent housing 31 and abuts ring 55. Air piston 50 is situated to selectively engage displacement member 52, including tab 53. Collet 44 is selectively held open by the activation of air piston 50 which moves sliding ring 55, pin 58, spindle 40 and collet 44 forward. First, second, and third base plates 70, 72 and 74 hold rotation assembly 80 in place horizontally and vertically, but allow the assembly to rotate with various bearings 76. Connectors 78 such as nuts and bolts are used to hold the base plates together.

In one embodiment, pin 58 is smooth or roughened and held in place by a frictional fit with ring 55 and/or spindle 40. In alternate embodiments, pin 58 is a threaded pin, a set screw or a bolt. Pin 58 can extend the entire diameter of ring 55 or only into spindle 40. Alternately, two pins can be used. Pin 58 can also be a member soldered, welded or otherwise solidly connected in place to hold a fixed relationship between ring 55 and/or spindle 40.

Figure 3:
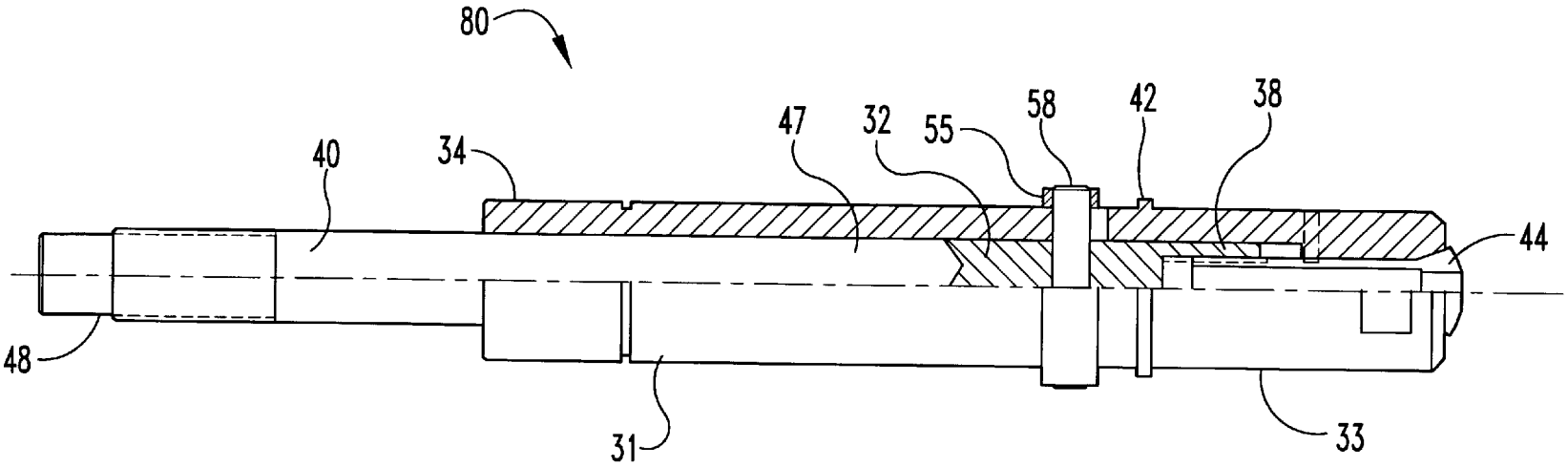
FIG. 3 is a side view of a housing assembly with a spindle and collet according to the embodiment of the present invention illustrated in FIG. 2.

Rotating assembly 80 is illustrated in FIG. 3 including housing 31, spindle 40, ring 55, pin 58 and collet 44. When driven, rotating assembly 80 rotates in place as held by the base plates and bearings. In one embodiment, spindle 40 and housing 31 are nested, generally cylindrical shapes.

Figure 4:
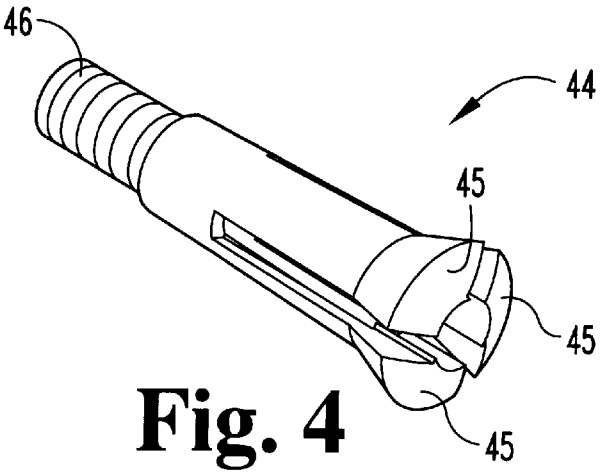
FIG. 4 is a perspective view of a collet used in accordance with the embodiment of the invention illustrated in FIGS. 2 and 3.

Collet 44, enlarged in detail in FIG. 4, includes a plurality of clamping prongs 45 and distal connecting portion 46. Collet 44 preferably has either 3 or 4 prongs 45, although more or fewer prongs 45 may be used as desired. Collet 44 is outwardly biased such that prongs 45 are open when collet 44 is tended, and prongs 45 are forced to close when collet 44 is retracted into the proximal end of housing 3 1. In one embodiment distal connecting portion 46 is threaded.

Figure 5A:
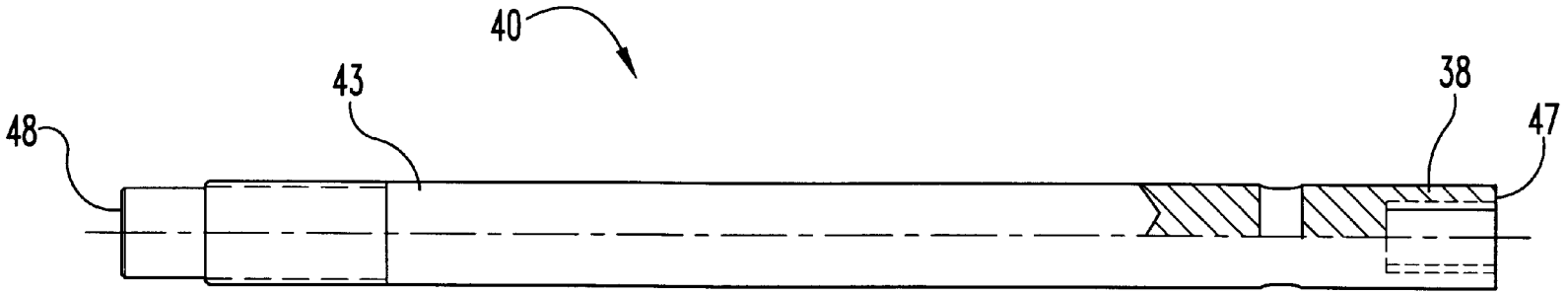
FIGS. 5A and 5B are side and top views, including interior lining, of a spindle used in accordance with the embodiment of the invention illustrated in FIGS. 2 and 3.
Figure 5B:
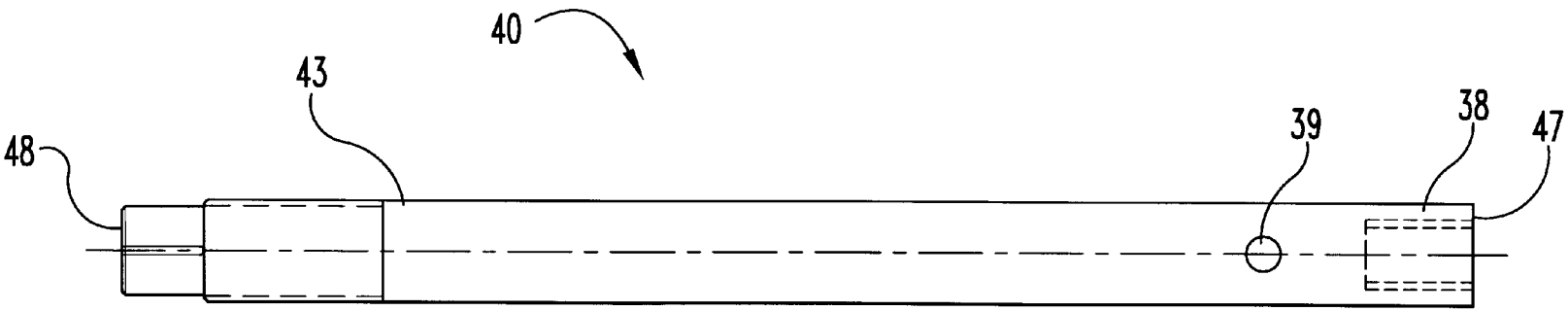

Side and top views of spindle 40 are shown in FIGS. 5A and SB. In one embodiment, spindle 40 includes ho ldi ng portion 38 which engages distal p ortion 46 of collet 44. In one embodiment, holding portion 38 threadedly engages distal portion 46. Holding portion 38 may engage distal portion 46 by any convenient means, including, and not by means of limitation, snaps, a retaining member, a fiiction fit, solid connection, or the like. Spindle 40 includes retainig pin hole 39.

Figure 6A:
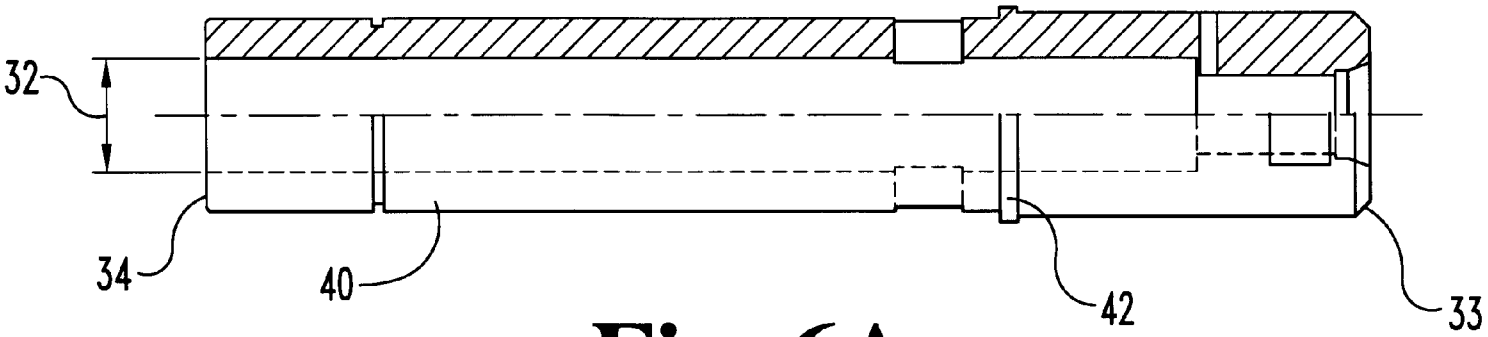
FIGS. 6A and 6B are side, partially cut-away view and a top view of a housing used in accordance with the embodiment of the invention illustrated in FIGS. 2 and 3.
Figure 6B:
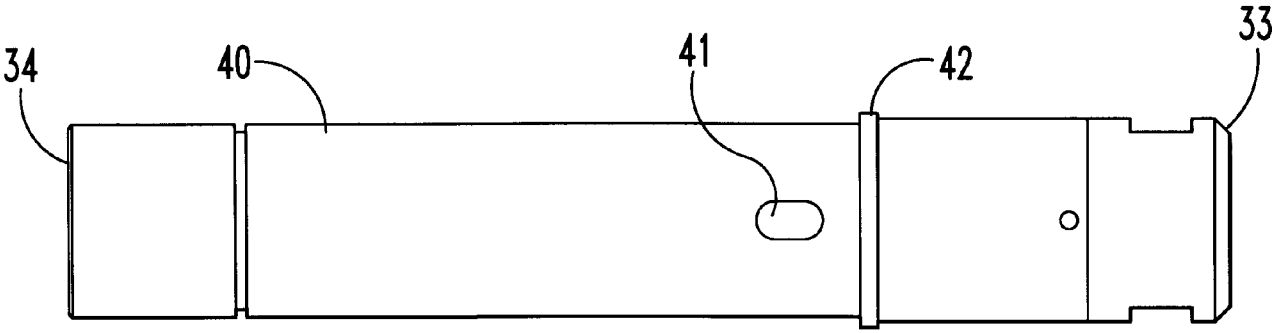
Figure 7A:
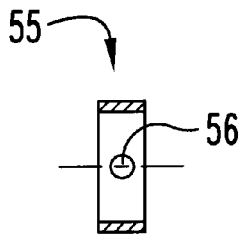
FIGS. 7A and 7B are side and top views of a ring used in accordance with the embodiment of the invention illustrated in FIGS. 2 and 3.
Figure 7B:
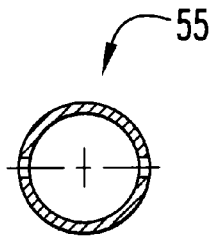

FIGS. 6A and 6B illustrate side and top views of housing 3 1, respectively. Housing 31 includes stop ring or flange(s) 42 which abut bearings in base plate 70 to prevent housing 31 from sliding forward during use. Housing 31 includes elongated retaining pinhole 41 which is aligned with retaining pin hole 39 in spindle 40. A reciprocating member, such as ring 55, illustrated in FIGS. 7A and 7B, is positioned around housing 31 (as shown in FIG. 3), with retaining pin hole 56 aligned with elongate housing retaining pin hole 41 and spindle retaining pin hole 39. Pin 58 is positioned through retaining pin holes 56, 41 and 39 such that when ring 55 is reciprocally moved along housing 31, there is sufficient room in elongate pin hole 41 to transmit the sliding motion to spindle 40 via pin 58, without slidably moving housing 31. Thus, reciprocal sliding movement of ring 55 extends and retracts collet 44 from the proximal end of housing 31. When spindle 40 is rotated, rotation assembly 80 which includes housing 31, ring 55, pin 58 and collet 44 are rotated as well. To enhance the spread of collet 44 upon extension, proximal end 59 of internal channel 32 of housing 31 can be flared.

Figure 2:
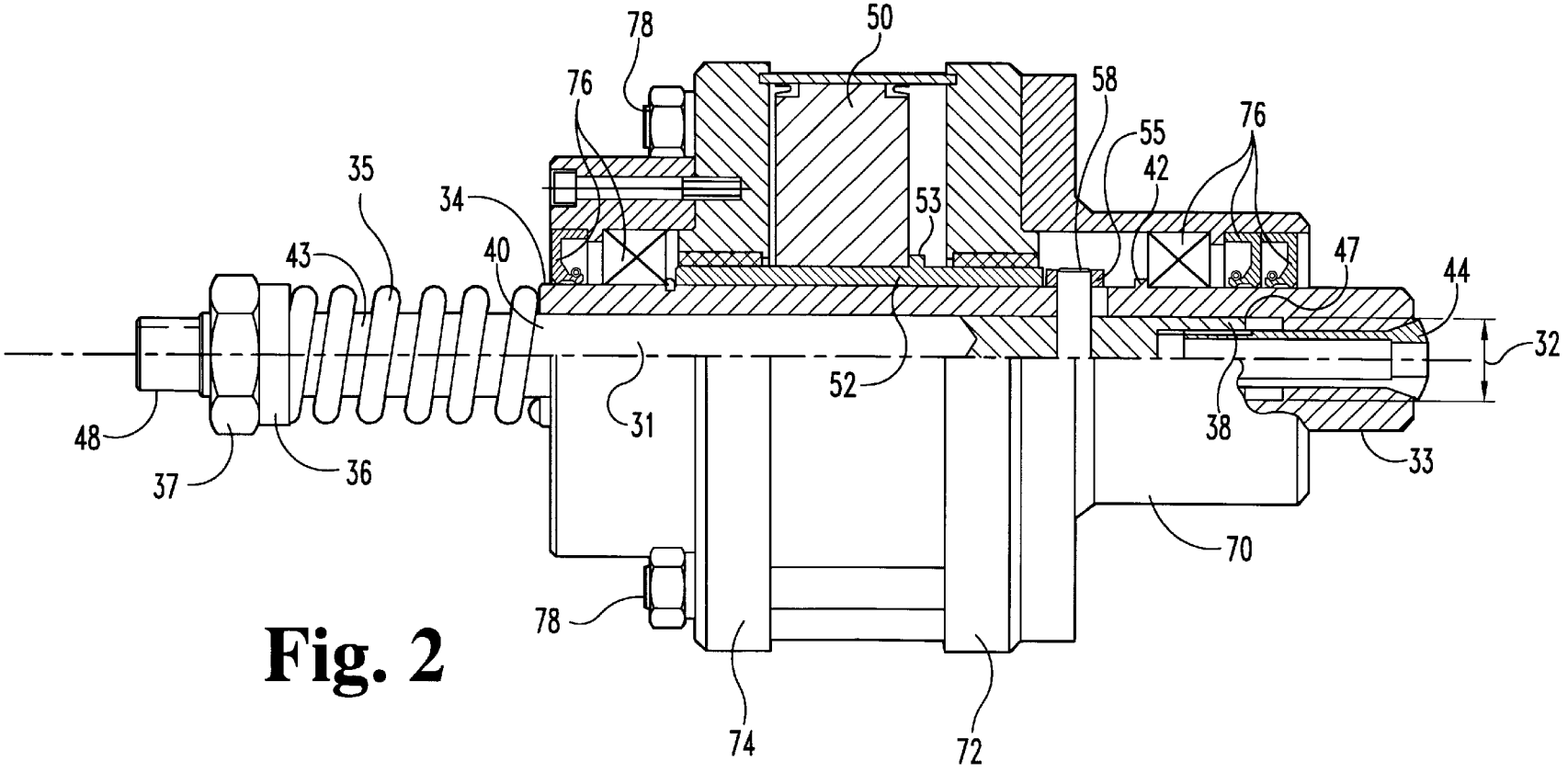
FIG. 2 is a side, partially cut-away view of a collet assembly according to one embodiment of the present invention.
Figure 8:
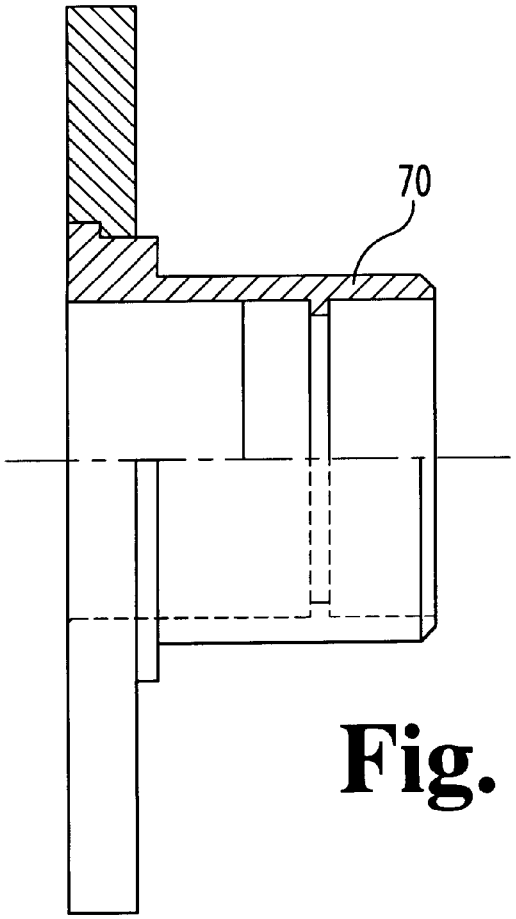
FIGS. 8 and 9 are side, cut-away views of bracket plates used in accordance with the embodiment of the invention illustrated in FIGS. 2 and 3.
Figure 9:
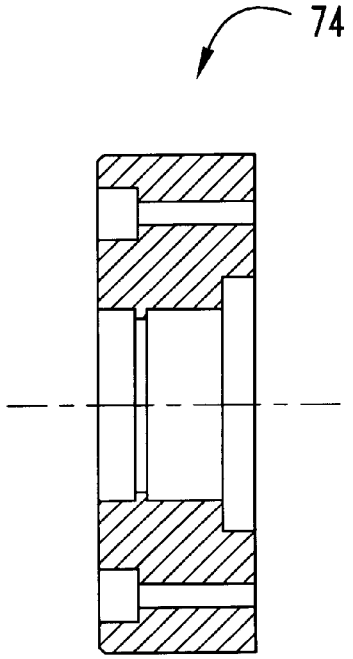

FIGS. 8 and 9 illustrate in greater detail the base plates and mounting brackets shown in FIG. 2. FIG. 8 is a cut-away view of first base plate 70, while FIG. 9 is a cut-away view of third base plate 74. Base plates 70, 72 and 74 are aligned and mounted to the frame and serve to prevent rotation assembly 80 from moving from a desired position while allowing rotation assembly 80 to rotate. The base plates include appropriate flanges, channels and tabs to hold rotation assembly 80.

Figure 10:
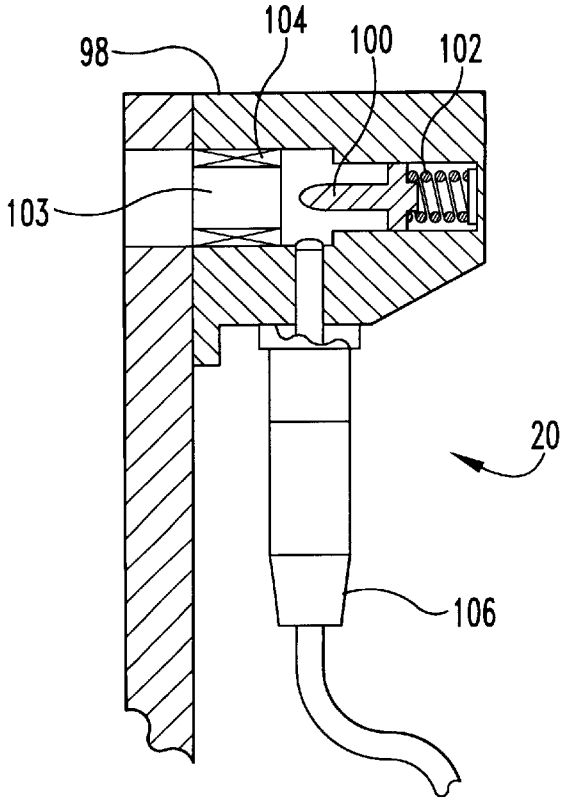
FIG. 10 is an enlarged cut-away view of a first embodiment of the tailstock of FIG. 1.

FIG. 10 shows one embodiment of tailstock 20. FIG. 10 illustrates a first embodiment of tailstock 20, having a tailstock housing 98 within which a pin 100 is recessed. Pin 100 is biased outwardly by spring 102 and may extend through a generally cylindrical housing recess 103. Bearing 104 is disposed within cylindrical housing recess 103 and is adapted to engage the proximal end of a workpiece 12.

In operation, workpiece 12 is loaded into system 10 and proximal end 13 is engaged by the pin 100 of tailstock 20. As tailstock 20 moves to further engage proximal end 13, proximal end 13 extends into housing recess 103 and is engaged by bearing 104. When proximal end 13 has traveled far enough into housing recess 103 to be completely engaged by bearing 104, pin 100 is recessed into housing 104 and sensor 106 sends a signal to a controller (not shown).

Figure 11:
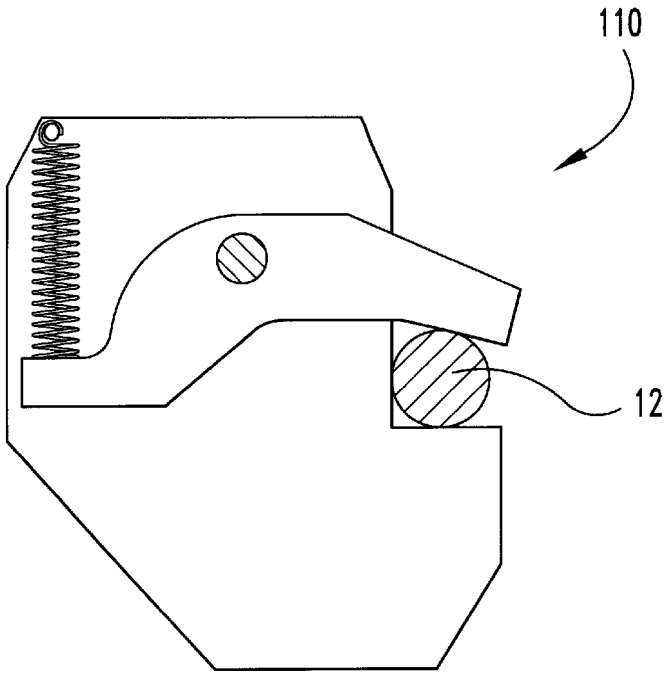
FIG. 11 is side view of a clamp used in an alternate embodiment of the tailstock of FIG. 1.

FIG. 11 illustrates a vertical clamp 110 which can be used instead of bearing 104 in an alternate embodiment of tailstock 20. Clamp 110, located proximate the opening to housing recess 103, is adapted to engage workpiece 12. In operation, workpiece 12 is loaded into collet assembly 30 and proximal end 13 is engaged by the clamp 110. After engagement of proximal end 13, the alternate embodiment operates substantially the same as tailstock 20.

When system 10 is used, a workpiece 12 is loaded onto support arms 17. Tailstock 20 is then advanced toward workpiece 12 until it engages proximal end 13. Workpiece 12 and tailstock 20 are moved until distal end 14 is within open collet 44 extended from air collet assembly 30. Collet 44 is selectively held open by the activation of air piston 50 which moves sliding ring 55, pin 58, spindle 40 and collet 44 forward. Once distal end 14 of workpiece 12 is within collet 44, air piston 50 is disengaged, where in spring 34 slidably retracts spindle 40 such that proximal end 33 of housing 31 forces collet 44 closed and locks it upon distal end 14 of workpiece 12. A rotation is then imparted to rotation assembly 80 to rotate workpiece 12. System 10 is advanced toward grinder 26 and held in place until a predetermined diameter of workpiece 12 is obtained. Upon the completion of grinding, the movement is reversed and air piston 50 is activated to eject workpiece 12. The next workpiece 12 may then be loaded onto system 10 and the steps repeated.

Appropriate bearings, bushings, spacers, placement tabs and connectors are used to hold the assembly together as will be understood by those of skill in the art. Air piston 50 is illustrated as one movement means for pushing displacement member 52. It will be understood that alternate hydraulic, pneumatic or mechanical means could be used as well.

For purposes of illustration, one embodiment of the air collet assembly has a length of 229 millimeters and a height of 85 mm. The housing has a diameter of 25.4 mm with the internal channel having a diameter of 15.1 mm until it reaches an interior shoulder at the proximal portion wherein the diameter is reduced to 13.5 mm. A 20 degree flare is imparted to the last 6.4 mm of the proximal end of the housing. In this embodiment the spindle has a standard diameter of 15.0 mm and a length of 210 mm prior to extended to the drive means. Retaining pin hole 39 has a diameter of 5.1 mm. Retaining pin hole 41 has a elliptical length of 5 mm between the foci plus a radius of 2.6 mm on each end. Retaining pin hole 56 has a diameter of 5 mm. These measurements are for illustration purposes only and are not intended to be limiting to the invention.

As will be understood by those of skill in the art appropriate materials may be used to construct the system and assembly including steel, rubber, and appropriate engagement surfaces having sufficient strength to engage and hold the workpiece during grinding and movement. As will be further understood by those skilled in the art, various motors, mechanical actuators, controllers, and sensors may be appropriately stationed to actuate and control the various mechanical and feedback operations of the system.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An assembly to hold the proximal and distal ends of a workpiece for grinding, comprising:

a support frame;

a tailstock slidably mounted on said support frame and operable to engage the proximal end of the workpiece; and, a collet assembly mounted on said support frame and configured to receive and engage the distal end of the workpiece, wherein said collet assembly includes:

a housing defining an open proximal end, defining an open distal end, and defining an internal channel extending along the length of said housing from said proximal end to said distal end;

a spindle slidably disposed within said internal channel of said housing, said spindle having a proximal end and a distal end wherein said proximal end includes a holding portion and wherein said distal end extends from said distal end of said housing and is engagable with a drive mechanism;

a collet disposed within said internal channel of said housing and connected to said holding portion, wherein said collet has a proximal end adjacent said housing proximal end, wherein said collet is resiliently biased such that said collet opens when advanced in the proximal direction and wherein said housing proximal end urges said collet closed when said collet is moved in the distal direction; and, means selectively engagable with said spindle for slidably advancing and retracting said spindle to advance and retract said collet.

2. The assembly of claim 1 wherein said means forslidably advancing and retracting includes a spring disposed between said housing and said spindle and biased to resiliently urge said spindle in the distal direction.

3. The assembly of claim 2 wherein said means forslidably advancing and retracting includes a reciprocal member slidably mounted externally to said housing and in a fixed position relative to said spindle.

4. The assembly of claim 3 wherein said collet assembly and said reciprocal member are rotatably mounted to said support frame.

5. The assembly of claim 4 wherein said reciprocal member is a ring.

6. The assembly of claim 4 wherein said means for slidably advancing and retracting includes an air piston adapted to selectively advance said reciprocal member in the proximal direction.

7. The assembly of claim 6 wherein said collet includes a plurality of clamping prongs adapted to open when said collet is extended from said housing proximal end and are further adapted to close when said collet is retracted into said open housing proximal end portion.

8. The assembly of claim 7 wherein said plurality of clamping prongs is 3.

9. The assembly of claim 3 wherein said collet includes a threaded distal end portion and wherein said holding portion is threaded such that said collet distal end portion engages said holding portion.

10. A rotatable collet assembly for holding an end of a workpiece, comprising:

a housing defining an open housing proximal end, an open housing distal end, defining an internal channel extending from said open housing proximal end to said open housing distal end and defining a first retaining pin hole;

a spindle having a spindle proximal end and a spindle distal end, slidably disposed within said internal channel, wherein said spindle proximal end includes a holding portion, wherein said spindle distal end extends from said housing distal end and is engagable with a drive mechanism, and wherein said spindle defines a second retaining pin hole in overlapping alignment with said first retaining pin hole;

a collet disposed within said internal channel of said housing and connected to said holding portion, wherein said collet has a proximal end adjacent said housing proximal end, wherein said collet is resiliently biased such that said collet opens when advanced in the proximal direction and wherein said housing proximal portion urges said collet to close when said collet is moved in the distal direction;

a reciprocating member mounted externally to said housing and defining a third retaining pin hole in overlapping alignment with said first and second retaining pin holes;

a pin mounted through said first, second and third retaining pin holes wherein said pin engages said second and third retaining pin holes and wherein said first retaining pin hole allows said pin to reciprocally travel in the proximal and distal direction in relation to said housing when said reciprocating member is moved; and, a spring disposed been said housing and said spindle asked to resiliently urge said spindle in the distal direction.

11. The collet assembly of claim 10 wherein said reciprocating member is a ring.

12. The collet assembly of claim 11 further comprising a displacement member engagable with said ring.

13. The collet assembly of claim 12 further comprising an air piston associated with said displacement member, wherein said air piston is engagable to selectively advance said displacement member in a proximal direction.

14. The collet assembly of claim 13 wherein said collet includes a plurality of clamping prongs adapted to open when said collet is extended from said housing proximal end and adapted to close when said collet is retracted into said open housing proximal end portion.

15. The collet assembly of claim 14 wherein said plurality of clamping prongs is 3.

16. The assembly of claim 13 wherein said collet includes an threaded distal end portion and wherein said holding portion is threaded such that said collet distal end portion engages said holding portion.

17. A rotatable collet assembly for holding an end of a workpiece comprising:

a housing defining an open housing proximal end, defining an open housing distal end and defining an internal channel extending from said open housing proximal end to said open housing distal end;

a collet slidably disposed within said internal channel, wherein said collet has a proximal end portion adjacent said housing proximal end, wherein said collet is resiliently biased such that said collet opens when advanced in a proximal direction and wherein said housing proximal end urges said collet closed when said collet is moved in a distal direction;

means associated with said collet to selectively advance said collet in relation to said housing;

a spring associated with said housing and said collet and biased to resiliently urge said collet in the distal direction.

18. The assembly of claim 17 further comprising a spindle slidably disposed within said internal channel, said spindle having a spindle proximal end and a spindle distal end, wherein said spindle proximal end is attached to said collet, and wherein said spindle distal end extends from said housing distal end and is engagable with a drive mechanism.

19. A method of holding a cylindrical workpiece for grinding wherein said workpiece has a proximal end and a distal end, comprising the steps of:

providing a support frame;

engaging the proximal end of the workpiece with a tailstock mounted to said support frame;

advancing a collet from a collet assembly wherein said collet assembly includes:

a housing having an open proximal end;

a collet rectally disposed within said housing, wherein said collet is disposed within said proximal end of said housing such that said collet is resiliently biased to open when advanced in the proximal direction and wherein said proximal end urges said collet closed when said collet is retracted; and, advancement means for selectively slidably advancing said collet proximally from said housing;

receiving the distal end of the workpiece within said collet;

retracting said collet to engage the distal end of the workpiece wherein said retraction is accomplished by a spring associated with said housing and said collet and resiliently biased to move said collet in a distal direction;

advancing said collet to disengage the workpiece after grinding; and ejecting the workpiece.

20. The method of claim 19 wherein said collet assembly offer comprises a spindle slidably disposed within said housing wherein said spindle has a proximal end coupled to said collet and wherein said spindle has a distal end attachable to a driving mechanism.

* * * * *

UNITED STATES PATENT AND TRADEMARK OFFICE

CERTIFICATE OF CORRECTION

PATENT NO. : 6,193,591 B1
APPLICATION NO. : 09/449372
DATED : February 27, 2001
INVENTOR(S) : Stahl et al.

It is certified that error appears in the above-identified patent and that said Letters Patent is hereby corrected as shown below:

On the Title Page, Item (54), change “COLLECT” to -- COLLET--.

In column 1, line 1, please change “COLLECT” to --COLLET--.

In column 1, line 37, please change “untiocollet” to --until the collet--.

In column 2, line 18, please change “rotate” to --rotating--.

In column 3, line 25, please change “the” to --in a--.

In column 4, line 31, please change “tended” to --extended--.

In column 4, line 36, please change “SB” to --5B--.

In column 4, line 36, please change “ho ldi ng” to --holding--.

In column 4, line 37, please change “p ortion” to --portion--.

In column 4, line 41, please change “fiiction” to --friction--.

In column 4, line 42, please change “retainig” to --retaining--.

In column 5, line 40, please change “where in” to --whereupon--.

In column 6, line 1, please change “a” to --an--.

In column 6, lines 53 and 54, please change “forslidably” to --for slidably--.

In column 6, lines 67 and 58, please change “forslidably” to --for slidably--.

In column 7, line 27, please change “aligmnent” to --alignment--.

In column 7, line 48, please change “been” to --between--.

In column 7, line 49, please change “asked” to --and biased--.

In column 8, line 2, please change “an” to --a--.

In column 8, line 40, please change “rectally” to --reciprocally--.

UNITED STATES PATENT AND TRADEMARK OFFICE

CERTIFICATE OF CORRECTION

PATENT NO. : 6,193,591 B1
APPLICATION NO. : 09/449372
DATED : February 27, 2001
INVENTOR(S) : Stahl et al.

It is certified that error appears in the above-identified patent and that said Letters Patent is hereby corrected as shown below:

In column 8, line 60, please change “offer” to --further--.

Signed and Sealed this

Thirty-first Day of July, 2007

JON W. DUDAS
*Director of the United States Patent and Trademark Office*